US008512036B2

(12) United States Patent
Ellis

(10) Patent No.: US 8,512,036 B2
(45) Date of Patent: Aug. 20, 2013

(54) APPARATUS FOR INCINERATING GASES FROM A PROCESSING CHAMBER

(76) Inventor: Frederick G. Ellis, Winnipeg (CA)

( * ) Notice: Subject to any disclaimer, the term of this patent is extended or adjusted under 35 U.S.C. 154(b) by 1235 days.

(21) Appl. No.: 12/325,573

(22) Filed: Dec. 1, 2008

(65) Prior Publication Data

US 2009/0142238 A1 Jun. 4, 2009

Related U.S. Application Data

(63) Continuation-in-part of application No. PCT/CA2007/002159, filed on Nov. 29, 2007.

(51) Int. Cl.
*F23G 7/06* (2006.01)

(52) U.S. Cl.
USPC ..... 432/72; 110/210

(58) Field of Classification Search
USPC ..... 432/8, 59, 72; 110/191, 235, 236, 110/203, 210; 454/3, 44; 422/174
See application file for complete search history.

(56) References Cited

U.S. PATENT DOCUMENTS

| | | | | |
|---|---|---|---|---|
| 2,448,048 | A * | 8/1948 | Porter | 55/404 |
| 4,009,301 | A | 2/1977 | Heckman et al. | |
| 4,398,472 | A * | 8/1983 | Burke et al. | 110/250 |
| 4,448,219 | A * | 5/1984 | van Hatten | 138/149 |
| 5,000,985 | A | 3/1991 | Salisbury | |
| 5,155,335 | A | 10/1992 | Habaki et al. | |
| 5,711,209 | A * | 1/1998 | Guines | 99/339 |
| 5,944,512 | A * | 8/1999 | Ludwig | 432/72 |
| 5,972,075 | A | 10/1999 | Fukuda et al. | |
| 6,194,688 | B1 * | 2/2001 | Ellis | 219/400 |
| 7,365,287 | B1 | 4/2008 | Ellis | |
| 2007/0095339 | A1 * | 5/2007 | Lyons et al. | 126/319 |

* cited by examiner

*Primary Examiner* — Kang Hu
*Assistant Examiner* — John Bargero
(74) *Attorney, Agent, or Firm* — Adrian D. Battison; Ade & Company Inc

(57) ABSTRACT

An oven for baking a batch of parts has a housing having side walls and a top wall defining a closed container with a closed top end and an open downwardly facing bottom end. Loading/unloading occurs at the bottom end onto a carriage raised to the top end where baking occurs. On each side is provided an array of heating elements below the top. A shield is located in front of the heating array so as to block direct radiation onto the parts to prevent over-heating as the carrying arrangement passes the heating array to be unloaded. The shield generates an upwardly flowing air stream to carry the heat to the top. The heating elements are mounted with their lower end in a connection box with a collar and insulated heat shield above the box to keep the electrical connections cooled.

12 Claims, 6 Drawing Sheets

APPARATUS FOR INCINERATING GASES FROM A PROCESSING CHAMBER

This application is a Continuation-in-part Application of PCT Application PCT/CA2007/002159 filed Nov. 29, 2007 and now abandoned.

The present invention relates to an apparatus for incinerating gases from a processing chamber and particularly but not exclusively for use with a vertical electrically heated oven for baking coated parts.

BACKGROUND OF THE INVENTION

Various products require a coating applied thereto to be baked to cure the coating so that it is fixed to the part. One example is that of circuit boards where a coating is applied and then baked. Another example relates to the powder coating of metal parts which is a relatively recent method for protecting and beautifying products. Powder coating makes a product highly chip and scratch resistant and highly chemical, petroleum and salt resistant. Powder coating has the ability to apply a thick, even coat without drips or sags and has premium insulating qualities, both electrical and thermal and also removes the cold feeling from metals. It gives a decorative finish to a product along with a protective finish which is resistant to fading. Powder coating has the ability to encapsulate products, wrap around corners, help eliminate sharp edges achieve with one high quality coat with no primer necessary and can resist abuse in low and high temperature variances. Powder coating has virtually unlimited number of colours and a wide variety of finishes.

Generally powder coating is applied to many metal products powder coatings are 100% solids coatings applied as a dry powder mix of resin and pigment and subsequently formed into a film with heat. The solid resin binder melts upon heating, binds the pigment, and results in a pigment coating upon cooling. The powder is applied either by an electrostatic spray or by passing the part over a fluidised bed of powder. In both cases the parts undergo subsequent oven heating to provide a smooth continuous film.

Powder coated materials have to be heated in an oven or the like, an example of a powder coat oven is shown in U.S. Pat. No. 5,155,335 issued October 1982 of Habaki et al wherein the oven has an inlet air shield chamber connected to a horizontal heating chamber. The oven of Habaki has a generally horizontal conveyor which is limited to one item at a time in the oven on the conveyor which is adequate for large items which need to be relatively spaced out but is not very effective for small items such as jewellery and the like.

U.S. Pat. No. 4,009,301 issued February 1977 of Heckman et al discloses a method for powder coating materials. A large apparatus is used to carry items on a conveyor through a series of steps wherein the item is powder coated and baked.

U.S. Pat. No. 5,000,985 issued March 1991 of Salisbury shows a similar method of powder coating wherein materials are carried on a conveyor through the processes.

The above patents are not effective for small objects and are relatively inefficient. it will be appreciated that the parts which are relatively small are generally suspended on the carriage from a hook or the like so that each is separate as it passes through the oven.

In U.S. Pat. No. 6,194,688 issued Feb. 27, 2001 of the present inventor is shown a novel construction of oven which comprises a housing having side walls defining a closed top end and an open bottom end, with a pair of opposed heating elements in the housing at the side walls. A carrying arrangement in the housing carries a batch of parts from the bottom end where the parts are loaded on to the carrying arrangement to the top end where the parts are baked by the heat rising from the heating element. The carrying arrangement is mounted on a guide which has a track located on respective side walls in the housing, a pair of wheel arrangements on the carrying arrangement engage each track and a cable is supported by a series of pulleys and is connected to a cable winch which is controlled by the control station for driving the carrying arrangement in the housing. The carrying arrangement has a removable rack comprising a series of hooks in which the parts are attached. The bottom end has an opening such that the carrying arrangement is accessible. The housing has insulated oven panels. The control station has an up control, a pause control, a down control, a temperature control meter and an upper holding time control. In this patent is disclosed an air blower for circulating the heated air in the oven mixing the air and making the temperature of the heat uniform.

In U.S. Pat. No. 7,365,287 issued Apr. 29, 2008 by the present inventor is disclosed a number of improvements to the above arrangement.

This oven shows significant improvements in energy efficiency and convenience of operation. However effluent gases must be extracted through a discharge duct at the top end and these can contain noxious gases and waste particles emitted in the paint curing process.

In U.S. Pat. No. 5,972,075 is disclosed a purifier for removing particles from exhaust gases where a filter is provide and is then heated to burn off the collected particles. Filter is unsuitable as it can restrict the flow of gases and residue from the processing chamber.

SUMMARY OF THE INVENTION

It is one object of the present invention to provide an apparatus for incinerating gases from a processing chamber which may be of the type in the above patents of the present inventor or may be of a different type where gases and particles can be released.

According to one aspect of the invention there is provided an apparatus comprising:

- a processing chamber comprising a housing having side walls and a top wall at a top end;
- at least one heating assembly within the housing at a position therein below the top end for generating heat in the housing;
- a ventilation outlet duct arranged at or adjacent the top end of the housing through which gases from the top end can discharge;
- and a heating tube connected to the outlet duct and including an electrical heating element for heating the gases to a temperature such that the gases are incinerated prior to release from an end of the heating tube.

Preferably the heating tube stands upright and includes a cover over the upper end.

Preferably there is provided a valve for controlling the rate of extraction of gas from the oven through the outlet.

Preferably the temperature of the gases in the heating tube is increased by reducing the rate of extraction of gas from the oven.

Preferably the temperature is maintained above 800 degrees F. and more preferably up to 1200.

Preferably there is provided a venturi actuated by a stream of gas injected into the outlet duct or the tube to assist in causing a flow of the gases.

Preferably the heating element comprises an elongate element extending generally longitudinally of the tube at or adjacent an axis of the tube.

Preferably the heating element is arranged with a first section thereof which is arranged to generate a reduced amount of heat.

Preferably the heating tube includes an end cap closing the end of the tube such that the gases impact upon an inner face of the end cap and are diverted thereby, the end cap defining at least one passageway therethrough such that the diverted gases are released from the tube through the end cap.

Preferably there is provided a plurality of passageways arranged at angularly spaced positions around an axis of the tube.

Preferably the end cap includes a valve and valve seat therein for restricting the flow of the gases through the end cap.

Preferably the valve is arranged such that it includes a shaft extending along an axis of the tube and includes an end plate at right angles to the axis and facing downwardly into the tube.

Preferably the valve includes a conical valve wall extending from the end face and surrounding the axis which cooperates with a conical valve seat in the end cap.

Preferably the end cap is formed of a ceramic or graphite material.

Preferably the heating element comprises a heating rod containing a resistance heating wire which extends from a support base at one end of the tube.

Preferably the heating rod extends along the tube to a position adjacent a discharge end of the tube where the heating rod is bent back to form a U-shaped portion.

Preferably the heating tube is arranged for mounting at an exterior location and includes a cowl on an upper end covering a discharge end of the tube.

Preferably the heating tube includes an inner cylindrical wall which is surrounded by a layer of insulation.

Preferably the housing defines a substantially closed container with a substantially closed top end and an opening at a bottom end such that the discharge duct acts to draw gases from the top end to inhibit release of gases at the open bottom end.

BRIEF DESCRIPTION OF THE DRAWINGS

One embodiment of the invention will now be described in conjunction with the accompanying drawings in which.

In the drawings like characters of reference indicate corresponding parts in the different figures.

DETAILED DESCRIPTION

Figure 1:
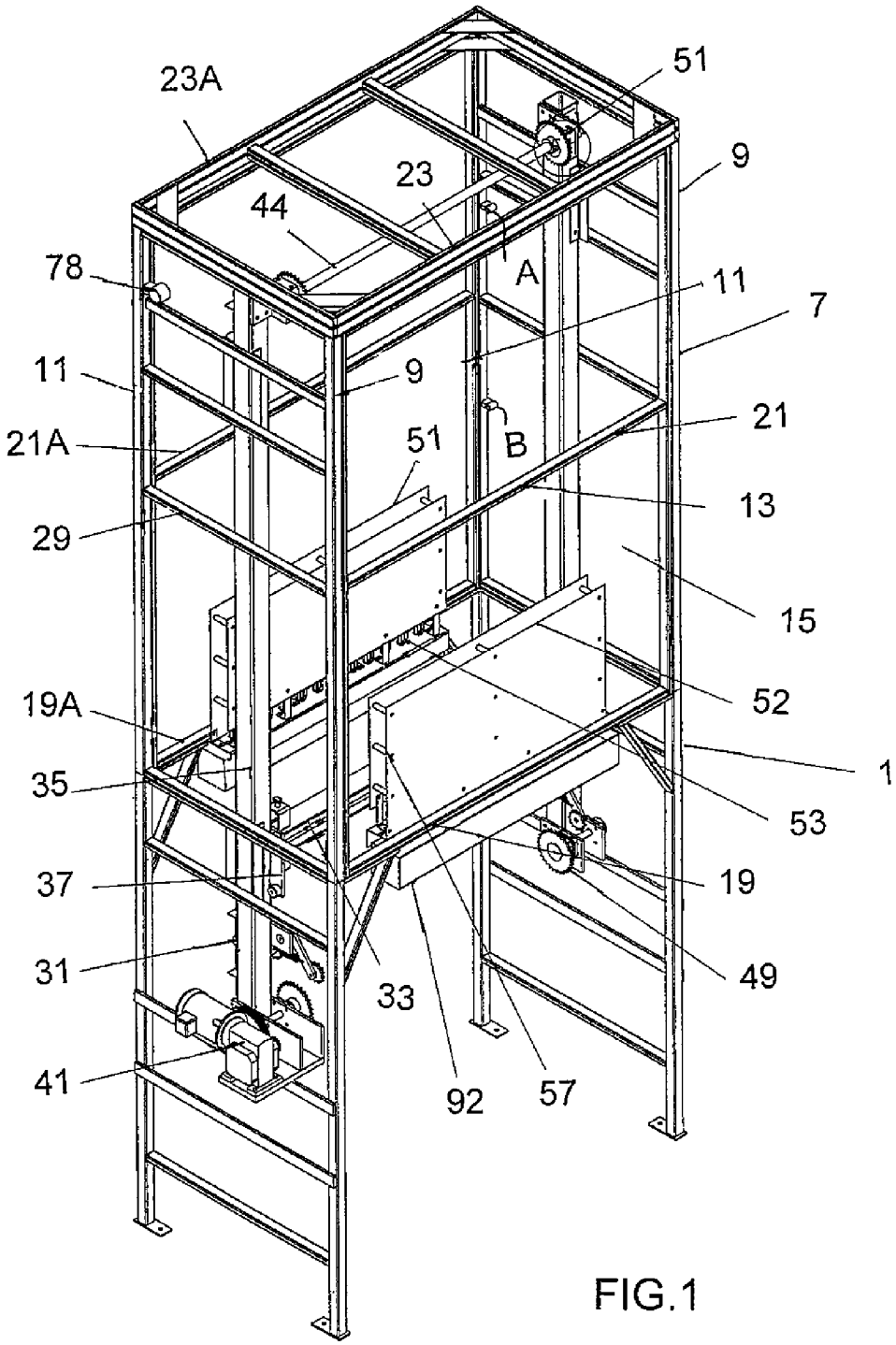
FIG. 1 is an isometric view of one embodiment of the oven according to the present invention with the cover panels removed to show the interior construction.
Figure 2:
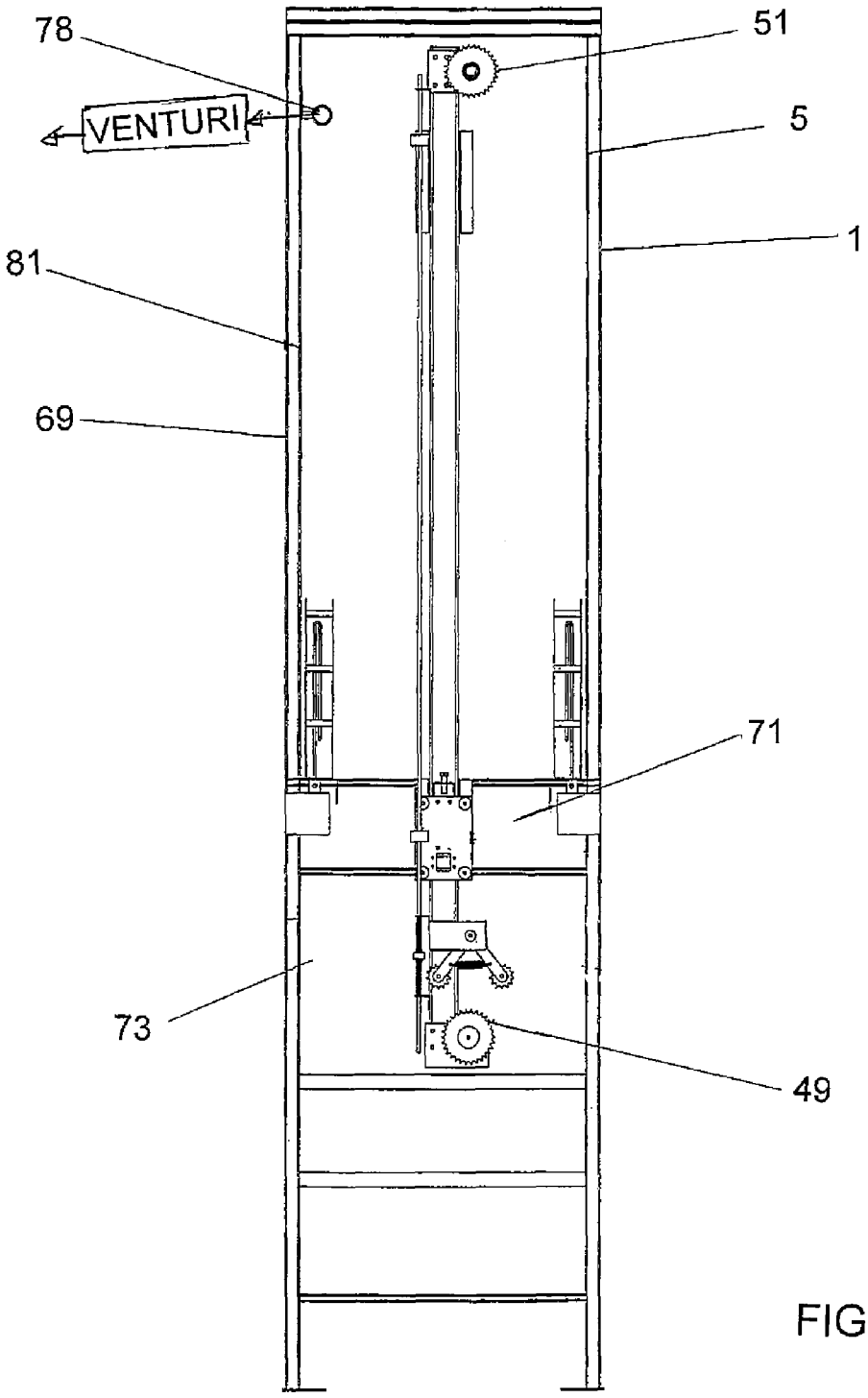
FIG. 2 is a vertical transverse cross sectional view of the oven of FIG. 1.

As shown in FIGS. 1 and 2, a baking oven, generally indicated as 1, is arranged to bake parts 3 carried on a frame 2, which parts have been coated with a suitable coating material such as powder coat.

In some arrangements the frame may carry a large number of smaller parts such as individual castings or the frame may carry a smaller number of larger parts, even to the extent of carrying a single part such as a large panel. The dimension of the oven and the frame can be selected in accordance with requirements to receive the number and arrangement of parts in the batch which are necessary or suitable for the process concerned. However in each case the parts or part form a batch which is processed in the oven by loading at the bottom, moving to the baking location and moving back to the loading station for unloading. This is different from a continuous or line process where the parts move along a processing line.

Powder coatings are 100% solids coatings applied as a dry powder mix of resin and pigment and subsequently formed into a film with heat. The solid resin binder melts upon heating, binds the pigment, and results in a pigment coating upon cooling. The powder is applied either by an electrostatic spray or by passing the heated object over a fluidized bed of powder with subsequent oven heating to provide a smooth continuous film.

The oven has a housing 5 and a frame 7 for supporting the housing. In FIG. 1, the panels covering the frame 7 and forming the housing are omitted for convenience of illustration. The frame has two elongate front vertical posts 9 and two elongate rear vertical posts 11 arranged parallel to each other and the two front posts and the two rear posts are spaced equidistantly apart such that the frame is rectangular shaped. The dimensions can vary but in general the frame is higher than it is wide. A plurality of cross beams 13 connect the vertical posts such that the frame has a hollow interior 15. A first set of cross beams connect the front posts wherein a first beam 19 is located generally at the bottom of the posts, a second beam 21 is located approximately at the middle of the posts and a third beam 23 is located at the top end of the posts. A second set of cross beams connect the rear posts wherein a first beam 19A is located generally at the bottom of the posts at the same height and parallel to the first beam 19 of the first set. A second beam 21A located approximately at the middle of the posts at the same height and parallel to the second beam 21 of the first set. A third beam 23A is located at the further most top end of the posts at the same height and parallel to the third beam 23 of the first set. The first set and second set of beams are parallel and of the same length.

A set of side beams 29 connect the front posts to the rear posts which are perpendicular to and at the same height as each of the second set of beams connecting a respective front post to a respective rear post. The side beams are shorter in length than the first and second set of beams.

A carrying arrangement 31 is arranged to carry the parts upwardly and downwardly on a rack 33 in the hollow interior 15 of the frame. The carrying arrangement is mounted on tracks 35 which extend upwardly from the bottom end along each side of the frame on the side beams parallel to the posts. Each of the tracks is arranged to support a respective wheeled carriage 37. The wheels of the carriages 37 engage the track 35 such that the carrying arrangement is movable upwardly and downwardly through the hollow interior along the track. The carrying arrangement is moved by a motor 41 mounted on the frame on a cross beam adjacent to the middle beam which drives a chain at the adjacent track and drives though a cross shaft 44 a corresponding chain at the opposite track. The chains run over top and bottom sprockets 51 and 49 which are located within the housing at the top and bottom respectively of the tracks 35. The carrying arrangement is thus moved directly vertically upwardly and downwardly in the oven, as mentioned above by the two chains which are maintained in synchronism by the cross shaft 44. Thus the carrying arrangement follows the same vertical path in its movement with no side to side or horizontal movement which could cause shaking or jiggling of the parts. Also the cross-shaft 44 ensures that the movement of the two sides is simultaneous to prevent any tilting or binding of the parts or the carrying frame.

A heating arrangement 57 in the oven is arranged to heat the parts when raised by the carrying arrangement, as described in more detail hereinafter. A main control panel (not shown) is provided which has a main breaker and controls the motors up and down drive, pauses the motor and controls the temperature and has a holding timer for holding the parts in the carrying arrangement at the top end of the oven for baking.

Figure 4:
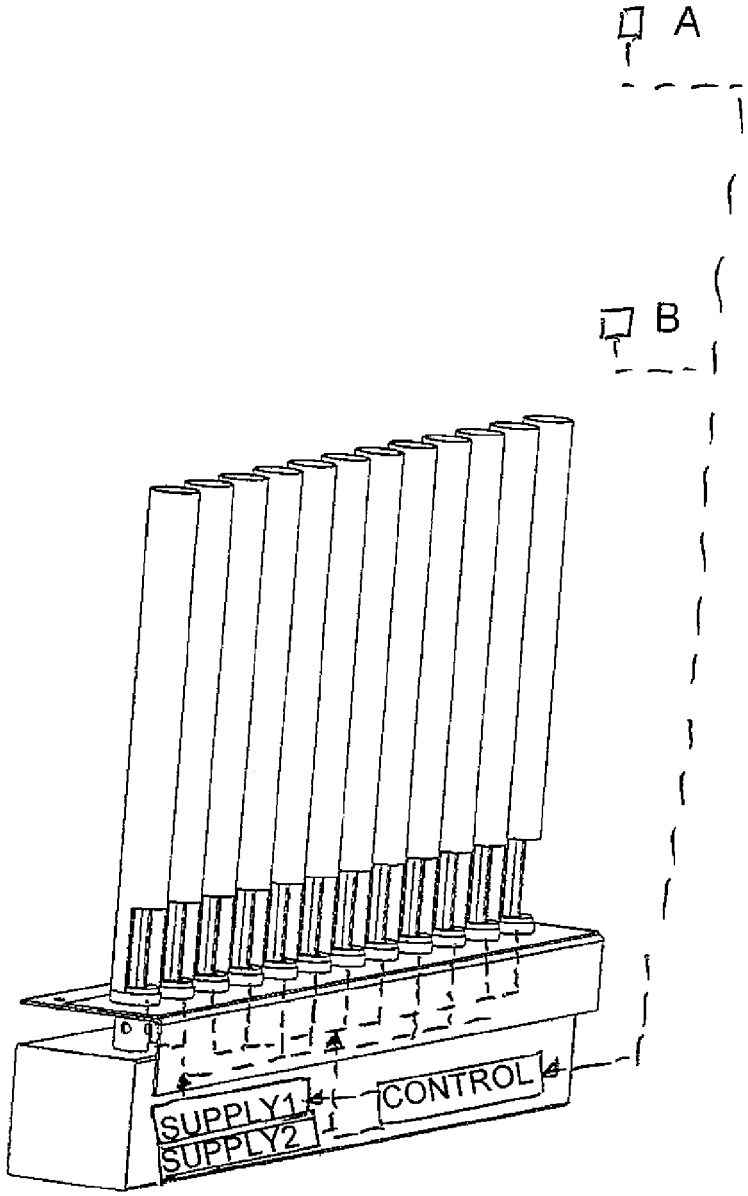
FIG. 4 is an isometric view showing schematically an alternative construction of heating assembly for use in an oven of the type generally shown in FIGS. 1 and 2.

As shown in FIGS. 1 and 4 there are two pyrometer thermocouples A and B located at the top end in the oven for measuring the temperature of the oven so that the oven can be heated at a required predetermined temperature. The temperature sensor A is located at the top of the heating zone where the parts are located during the baking process and this is spaced downwardly from the top wall of the housing. The temperature sensor B is located at the bottom of the heating zone and this is spaced upwardly from the top of the heating assembly.

The housing includes insulated oven panels 69 arranged such that the oven is fully closed at the side walls and top 74 and an opening 71 is located only at the bottom defining a loading and unloading zone 73 below the open bottom 71 of the oven. A ventilation outlet 78 is located at the op in one side wall closely adjacent the top wall. The ventilation outlet is arranged to remove fumes from inside the oven and carry the air through a pipe so that the air is released outside the building.

Inner walls 81 in the oven are made of reflective material, such as stainless steel or galvanized zinc, so that the infrared rays from the heating elements are reflected onto the parts for baking.

In operation, after powder coating, the parts are placed onto the rack which is then placed onto the carrying arrangement. The control panel is activated such that the carrying arrangement is raised vertically into the oven. The carrying arrangement is held in the oven at the top above the heating elements for a predetermined amount of time so that the parts are baked and the carrying arrangement is lowered so that the rack can be removed and a second set of parts on a second rack can be placed onto the carrying arrangement for baking. When the rack reaches the closed top of the oven, the baking is carried out for a set baking period as set by the control system.

The vertical orientation of the oven creates an efficient unit with low energy costs and requires a very small floor space in a building. The oven allows easy loading and unloading of the rack of parts and the parts are maintained stationary on their hanging rack during movement by the direct vertical movement along the path of the tracks.

The heating assembly 57 comprises two separate heating members 51 and 52. These are symmetrical and arranged at opposite side walls so as to face one another across the width of the oven. The heating members 51 and 52 are arranged on the opposite side walls from the tracks so that the frame 33 carried on the tracks passes between the two heating members on its way to the top of the oven at a position spaced above the two heating members. Thus the heating action at the top of the oven is generated by air rising from the heating members rather than by direct irradiation of the parts within the oven at the top of the oven.

Figure 3:
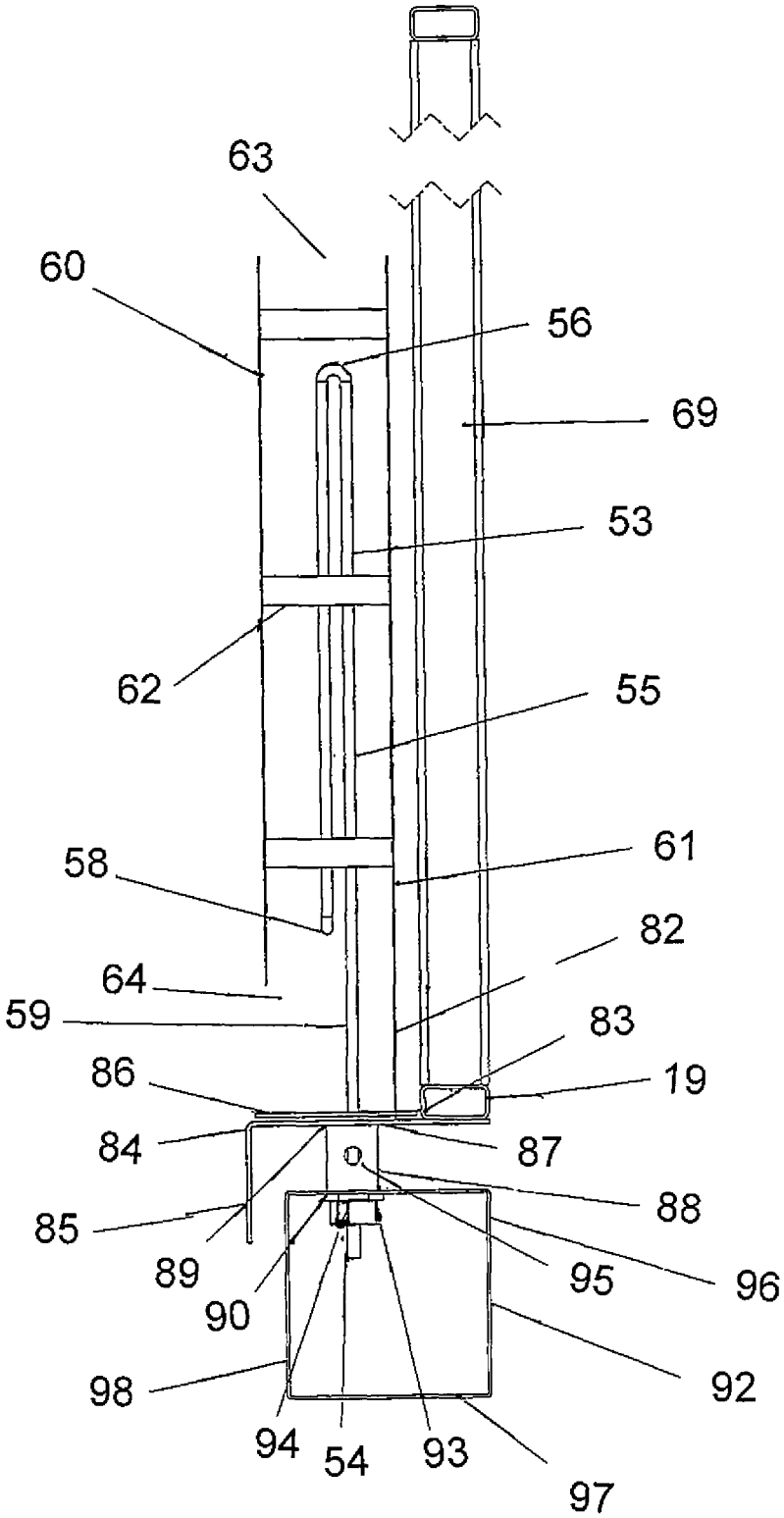
FIG. 3 is a cross sectional view of one heating assembly of the oven of FIGS. 1 and 2.

One of the heating members is shown in cross section in FIG. 3 and it will be appreciated that the other of the heating members is symmetrical and opposite to this and faces the heating member shown across the housing.

Thus the housing comprises a housing wall 69 as previously described which is supported on the frame members including the bottom frame member 19 which is shown. The wall panels are formed of an insulated material of a nature which can be selected by a person skilled in the art.

The heating member shown in FIG. 3 and also visible in FIG. 1 includes an array of heating elements 53 at spaced positions across the width of the heating member. Each heating element 53 includes a bottom mounting bracket 54 to which is attached a tubular container 55 standing upwardly from the bracket with a tubular container having an upper loop section 56 at which it turns downwardly to form a downwardly projecting portion 57 terminating at a lower end 58. Between the lower end 58 and the bracket 54 is a zone 59 of the heating element which is unheated. Thus the heating effect generated by the resistance heating member within the tube is concentrated in the area above the lower end 58 in both of the legs of the tube in that area. Heating elements of this type are of course well known and commercially available. In this embodiment the length of the section 59 which is unheated and acts to merely transport the electricity within cables within the heating element to the resistance heating section above the lower end 58. The section 59 is therefore relatively cool and is heated only by conduction and radiation from the heated section.

The heating elements are supported by the bracket 54 at the lower end so that they are freestanding upwardly from the bracket in a vertical array in a common plane along the sidewall with each heating element being spaced from the next and standing vertically parallel to the next.

The heating elements are located between an inwardly facing shield member 60 and an outwardly facing shield member 61. These shield members are supported in parallel spaced relation by a series of transverse posts 62. The space in between the shield members is arranged such that the heating element is spaced from both of the shield members and is generally equidistantly located between those two shield members. The height of the shield members is arranged such that the upper end of each of the shield members is above the upper end 56 of the heating element and the lower end of the shield members is below the lower end 58 of the heating element.

The shield members are formed of a suitable heat resistant material generally steel which can be stainless or galvanized steel. The shield members each formed by a single flat sheet of the shield material so that there is a channel defined between the shield members with an open top 63 of the channel and an open bottom 64 of the channel. This forms an air passage between the two shield members in that air can enter between the two shield members through the opening 64 of the lower end of the channel and can pass between the shield members to the upper open end 63 of the channel. The upper open end 63 is located below the baking zone at the top of the oven. The presence of the heating elements within the channel generates significant heat in this area which causes strong convention current within the channel acting to carry air from the opening 64 at the bottom through the opening 63 at the top so that air extends into the baking zone above the heating elements. The strong convection currents generated by this channel avoid the necessity for any form of fan or other air current assist system. The heating system is therefore a simple construction with no moving parts and yet carries the heated air to the top of the oven to the baking zone.

The inner shield member 60 covers the radiant heating section of the heating elements so that radiant heat directly from the heating elements is prevented from passing directly to the parts as they pass the heating elements on the carriage moving to or from the baking zone at the top of the oven.

The presence of the inner shield 60 is particularly important when the heated and baked parts are moved from the upper oven zone past the heating elements to the loading position 73 at the open bottom of the oven. It has been found that there is a tendency for the parts to be overheated as they pass the heating elements on the way down after the baking has been completed. Rather than turn off the heating elements as the parts pass, it is preferred to provide the shield which prevents the direct radiation impinging upon those parts.

The spacing between the shield members is arranged so that it allows air to pass between the shield members to generate an effective convection current of a significant volume of air to provide the heating at the oven zone at the top of the oven. The inner shield members 60 are spaced by a sufficient distance to allow the parts to pass between the shield members from the loading position to the baking position.

The channel defined between the shield members is a continuous channel along the length of the heating member spaced only by the sufficient numbers of the spacing posts 62 to hold the shield members properly vertical and parallel.

The outer shield member 62 inhibits the penetration of the heat from the heating elements to the panel 69. The shield member 62 thus acts to confine the heat between the two shield members for transportation by the air stream to the top of the housing.

The heating member defined by the heating elements and the shield members is mounted on the frame by a lower portion 82 of the outer shield member 61. Thus the lower portion 82 extends below the end of the inner shield member 60 and extends downwardly therefrom to the bottom member 19. At the bottom frame member 19 is provided a horizontal shielding plate 83 which is attached to the lower end portion 82 of the outer shield member 61. This shield plate 83 has an outer portion extending under the frame member 19 and an inner portion extending inwardly to a position beyond a plane parallel to the inner shield member 60 to an inner edge 84 at which is provided a down-turned flange plate 85.

The shield plate 83 thus provides a horizontal shield against downwardly radiated heat energy. A layer of insulation material 86 is applied on top of the plate 83 extends along the full length of the heating member so that it is coextensive with the inner and outer shield members. A similar layer of insulation can be applied underneath the plate 83 opposite to the layer 86 in addition to or as an alternative to the layer 86. This therefore provides generally an enclosure for the heating elements which is open only at the opening 64 between the lower end of the inner shield member and the plate 83. The shield plate 83 has a series of holes 87 at spaced positions along its length each for receiving a respective one of the heating elements 59. Thus each heating element extends from its respective bracket at the lower end through the hole 87 in the plate 83 into the channel between the inner and outer shield members. The layer 86 of the insulation material acts to inhibit heat from passing downwardly to a position below the shield plate 83 where it can act to heat the bracket 54. Attached to the underside of the shield plate 83 at each of the holes 87 is provided a sleeve 88 which is welded at 89 around the hole 87 and extends downwardly therefrom to a lower end 90. The lower end of the sleeve 88 is threaded as indicated at 91 to receive a threaded section of the bracket 54 so that a male thread of the bracket 54 screws into the female thread of the sleeve 88. A rectangular box 92 is attached to the lower end of the sleeves 88 by a flange 93 which is screwed up against the underside of the top plate 94 of the box so that the top plate 94 is held clamped against the bottom of the sleeve by the flange 94 and by the threaded bracket 54. The sleeve 88 has a series of holes around its periphery to allow the entry of air through each of the holes 95 to flow into the area above the bracket 54 and surrounding the lower end of the element 59 so that the air can pass upwardly through the holes 95 and outwardly through hole 87 to cause a flow of cooling air around the lower most end of the heating element 59.

The box 92 has depending side walls 96 and 98 attached to the edges of the top wall 94 together with a bottom wall 97 which can act as an opening to allow access to the interior of the box. The box 92 extends along the full length of the heating member and acts to contain the electrical wires and electrical connections to the brackets 54 of each of the heating elements. The plate 85 can extend to a bottom edge partly along the side wall 98 of the box 92 as shown or may be extended so that it covers the whole of the wall 98 to reduce impact of reflected heat on the box 92.

Thus each heating element passes through its respective hole 87 in the plate 83 and then passes through its respective sleeve 88 to its bracket underneath the top wall 94 of the box 92.

The box 92 and the electrical connections contained therein are therefore maintained cool by the air flow through the sleeve 88 and by the shield plate 83 and its insulated covering layer 86.

Heat therefore from the heating element is confined so that it generally passes upwardly through the channel and little of the heat communicates downwardly to the electrical components within the box 92. This maintains electrical components at a cooled temperature sufficiently low to avoid damage to those electrical connections and to the bracket 54 itself.

Figure 5:
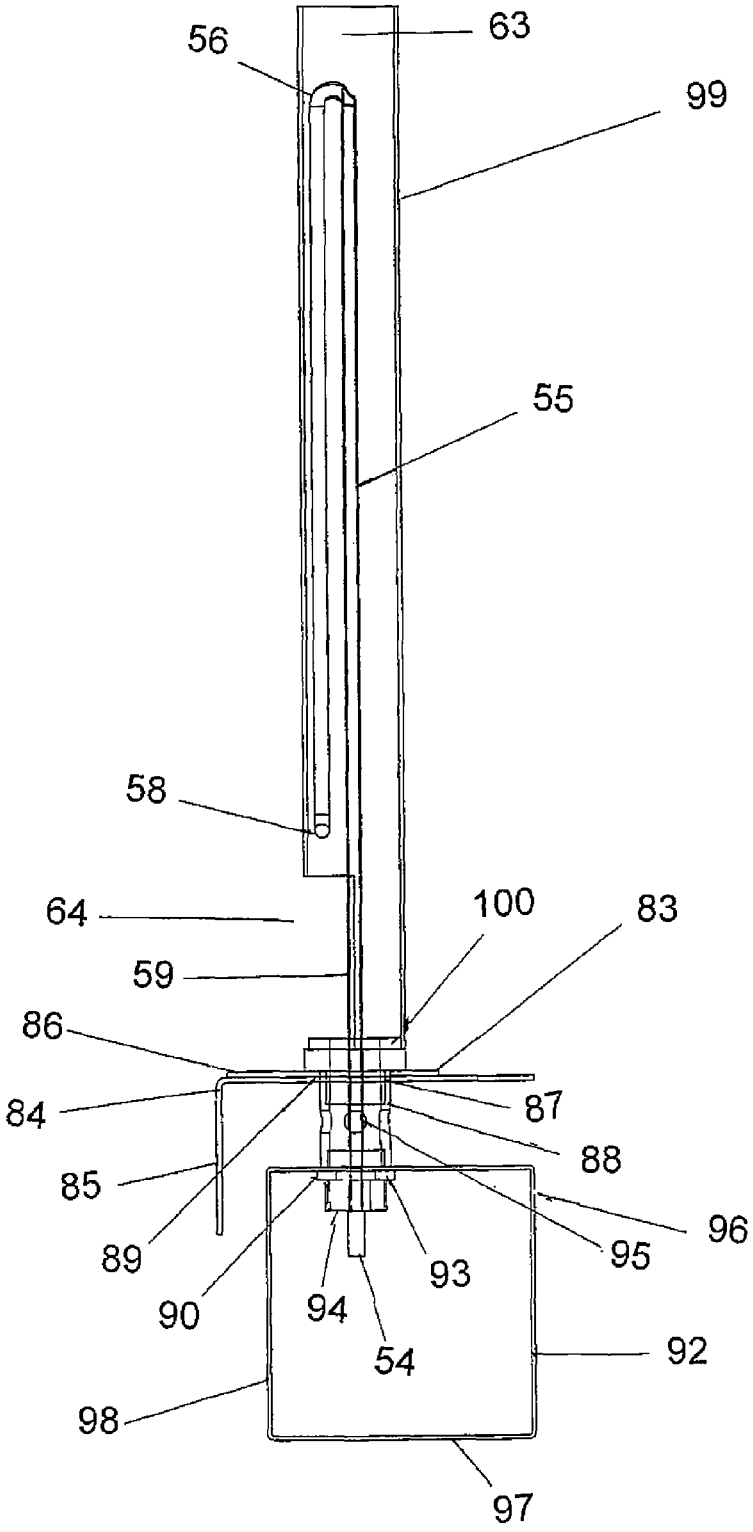
FIG. 5 is a cross sectional view of the heating assembly of FIG. 4.

Turning now to FIGS. 4 and 5 there is shown an alternate heating unit assembly. The difference with this unit is that each of the heating elements 55 is encased in a respective one of a plurality of stainless steel heat shield tubes 99. These tubes form a series of parallel ducts through which the air passes as previously described to flow to the top of the housing. Each tube has a cut out portion on the front face in the area below the heating section of the element to allow the air to enter that cut out. Each tube has its lower end welded to a heat shield tube holder 100. This holder is in turn threaded into the sleeve 88. The heat shield tube 99 is open at the top 63 to allow the hot air to rise and is cut open on half the tube at the lower end 64 to allow cool air to enter the tube. All other items are maintained as in the initial design.

The heating zone between the temperature sensors A and B is spaced downwardly from the top of the housing and below the discharge opening 78 which is itself spaced downwardly from the top wall. Thus when the discharge opening draws air out from the housing it does so above the heating zone leaving a layer or cushion or volume of heated air above the heating zone which can act as a heat buffer. The discharge opening is controlled by a venturi which acts to generate a forced flow in the discharge direction to a suitable discharge area to carry any contaminants away from the oven and the parts being baked. The venturi can be automatically controlled based on detection of escaping contaminants or on temperature changes at the oven heating zone.

The two thermocouples or temperature sensors are arranged to maintain the temperature at the sensor within a temperature of a predetermined range by activating selected ones of the heating elements 53. In FIG. 4 it will be noted that the temperature sensors provide a control signal to a control unit to the heating assemblies. In the embodiment shown the control unit drives two separate power supplies to separate ones of the heating elements in dependence on the temperature as detected by the respective sensors. Thus each heating assembly comprises an array of side by side heating elements and the heating elements are separated into said first and second parts at spaced alternate positions across the heating assembly. In particular the elements are separated into pairs so that the first two are connected to the first supply and the second two are connected to the second supply and so on across the width of the heating assembly. Thus as each temperature sensor drops below its set value, it acts to turn on one half of the heating assemblies in a spaced pattern across the width to add additional heat. This arrangement has been surprisingly found to maintain the whole heating zone within a predetermined temperature differing from the set value by no more than 5 degrees Celsius. This close control ensures that all of the parts of the batch see the same baking temperature with consistent baking of the parts.

Figure 6:
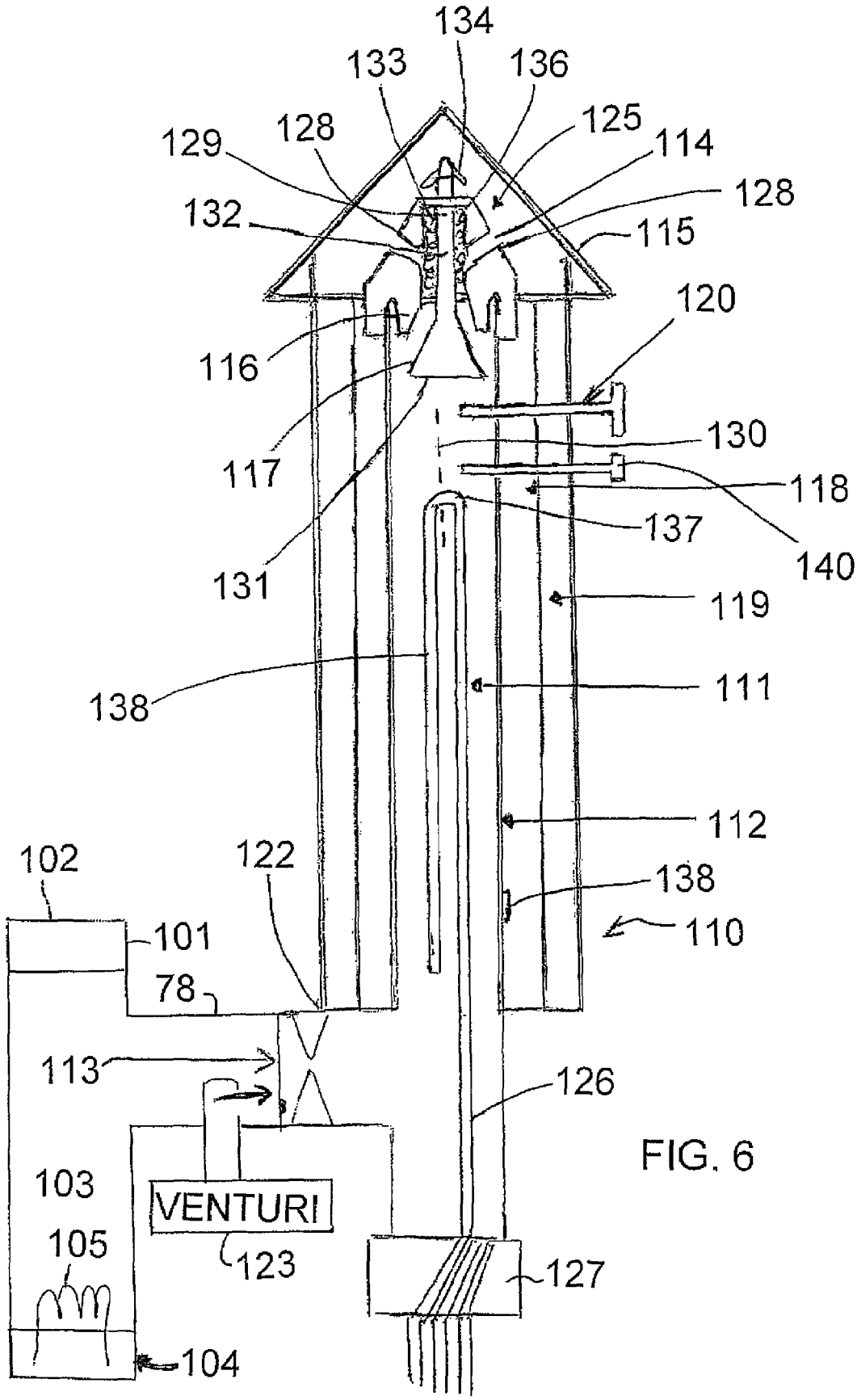
FIG. 6 is a cross sectional view through an outlet gas discharge device connected to the top outlet 78 of the heating assembly of FIG. 1.

Turning now to FIG. 6 there is shown a gas and residue incineration device 110 for connection to the outlet 78 of the top of a processing chamber 101 which may be the oven of FIG. 1 or another arrangement which includes a closed top 102, side walls 103 and an open bottom 104. The device 110 comprises a tubular duct 112 which is of the same construction as the duct 99 of FIG. 5 and has an opening 113 at the lower end for entry into the vertical duct of gases from the outlet 78.

The processing chamber 101 includes at least one heating assembly 105 within the housing at a position therein below the top end for generating heat in the housing.

The ventilation outlet duct 78 is arranged at or adjacent the top end of the housing through which gases and residue from the top end can discharge.

A venturi 121 acts to generate flow in the gases in the event that the pressure at the outlet 78 is insufficient to carry the gases into and through the device 110. The venturi include a restriction 122 of conventional shape and an air injection system 123 to generate the required flow, the air flow rate of which can be varied to change the rate of flow of gases into the device.

The tube contains a heating element 111 corresponding to the element 55 so that gases within the tube are heated from a temperature of the order of 400 C emerging from the oven to over 1500 C within the tube. This acts to burn any toxic or noxious gases and residue including particles of paint powder released in the processing system carried from the top of the oven.

A cowl 115 is located on top of the open top mouth of the tube so that the tube can be located to the exterior of a building housing the oven. This allows the oven to be used while maintaining to a minimum the release even to the exterior of any unacceptable gases generated in the curing of the powder coat material. The slight excess pressure generated in the oven by the heating of the gases is in some cases sufficient to generate a pressure at the outlet 78 of a few pounds which causes the flow through the outlet to the exterior and through the tube without the necessity of a fan or other propulsion system. In other cases the venturi can be used. The rate of flow can also be enhanced by the heat generated in the tube and the rate can be controlled by varying the air flow through the tube 112 by operating an air flow control valve 114 at the top of the tube. The valve is constructed of a heat resistant material such as graphite or ceramic. The valve has a conical seat 16 and a matching conical plug 117 the height of which within the conical seat can be adjusted by sliding a vertical mounting rod upwardly and downward in the discharge duct at the top of the seat. The tube 112 is insulated by an inner layer of refractory material 118 and an outer layer of fiber insulation 119. A temperature sensor 120 projects into the tube 112 and controls the temperature to establish a temperature in the range 1200 to 1500 degrees F.

In this way, both the temperature of the withdrawn gases and the rate of extraction of the gases generated in the curing can be controlled to ensure that all toxic materials are incinerated and that little or no such gases escape from the open bottom of the oven into the building interior.

The heating tube 112 is connected to the outlet duct and includes an electrical heating element for heating the gases to a temperature such that the gases and residue are incinerated prior to release from an end of the heating tube. The heating tube 112 stands upright. The control valve 114 is defined in a cover 125 over the upper end of the tube which has a circular recess at the bottom end into which the top end of the tube is inserted. The valve for controlling the rate of extraction of gas from the oven through the outlet is adjusted to provide an outlet area which throttles the gases to maintain the temperature of the gases and residue in the heating tube at an increased desired level by reducing the rate of extraction of gas from the oven, and preferably the temperature is maintained above 800 degrees F.

The heating element comprises an elongate element 11 extends generally longitudinally of the tube at or adjacent an axis of the tube and includes a first section 126 thereof extending from a mounting base 127 which is arranged to generate a reduced amount of heat.

The end cap 125 closing the end of the tube causes the gases to impact upon an inner face of the end cap and to be diverted thereby. The end cap 125 defines at least one passageway 128 therethrough such that the diverted gases are released from the tube through the end cap. In the embodiment shown there is a plurality of passageways 128 arranged at angularly spaced positions around an axis of the tube and inclined from behind the valve upwardly and outwardly to a discharge opening on a conical end face 129 of the cap 125.

The valve 116,117 is arranged such that it includes a shaft 129 extending along an axis 130 of the tube and includes an end plate 131 at right angles to the axis and facing downwardly into the tube and a shaft 132 extending through a bore 133 of the cap so that the shaft can be adjusted longitudinally of the axis by a nut 134 at the top end, with the shaft being biased downwardly by a spring 136.

The heating element 111 comprises a heating rod containing a resistance heating wire which extends from a support base at one end of the tube and extends along the tube to a position adjacent a discharge end of the tube where the heating rod is bent back at a bend 137 to form a U-shaped portion 138.

The heat to the heating element is controlled by a thermostat controlled by two sensors 120 and 140 located at spaced positions along the tube with the former located close to the end cap and the latter close to the top of the heating element. These are used to maintain both locations above set temperatures.

The invention claimed is:

1. Apparatus comprising:

a processing chamber comprising a housing having side walls and a top wall at a top end extending across and closing the top end;

at least one heating assembly within the housing at a position therein below the top end for generating heat in the housing so as to rise to the top end of the housing;

a ventilation outlet duct arranged at or adjacent the top end of the housing through which gases and residue at the top end are discharged;

and an incinerator connected to the outlet duct and for heating the gases to a temperature such that the gases and residue escaping through the outlet duct from the closed top end of the housing are incinerated prior to release;

the incinerator comprising:

an upstanding tube;

a mounting member at a bottom end of the tube closing the bottom end;

an inlet at one side of the tube adjacent the bottom end of the tube to which the outlet duct is connected for discharge of the gases and residue into the inlet of the tube;

an electrical heating element in the form of a rod with a resistance heating wire therein having a bottom end of the rod attached to and carried by the mounting member;

the heating element extending from the mounting member at the bottom of the tube along the tube and past the inlet;

the tube having an upper end for discharge of the gases and residue after heating by the heating element within the tube;

the tube being closed except at the upper end and at the inlet so that the gases and residue entering the inlet all pass to the upper end for discharge from the tube;

a layer of insulation surrounding an outside surface of the tube;

an end cap at the upper end of the tube shaped and arranged to cause the gases and residue to impact thereon and to be diverted thereby;

the end cap having at least one passageway therethrough such that the diverted gases are released from the tube through the end cap;

and a valve in the end cap operable to vary a rate of flow of the gases and residue through the upper end of the tube.

2. The apparatus according to claim 1 wherein the temperature of the gases and residue in the tube is increased by reducing a rate of flow of the gases and residue through the tube from the processing chamber.

3. The apparatus according to claim 1 wherein the incinerator is arranged such that a temperature of the gasses and residue in the tube is maintained above 800 degrees F.

4. The apparatus according to claim 1 wherein there is provided a venturi actuated by a stream of gas injected into the outlet duct to assist in causing a flow of the gases and residue through the outlet duct from the housing.

5. The apparatus according to claim 1 wherein the heating element extends generally longitudinally of the tube at or adjacent an axis of the tube.

6. The apparatus according to claim 5 wherein the heating element includes a first section adjacent the mounting member and a second section remote from the mounting member and wherein the heating element is arranged such that the with a first section thereof which is arranged to generate a reduced amount of heat relative to the second section.

7. The apparatus according to claim 1 wherein said at least one passageway comprises a plurality of passageways arranged at angularly spaced positions around an axis of the tube.

8. The apparatus according to claim 1 wherein the valve is arranged such that it includes a shaft extending along an axis of the tube and includes an end plate at right angles to the axis and facing downwardly into the tube.

9. The apparatus according to claim 8 wherein the valve includes a conical valve wall extending from the end plate and surrounding the axis which cooperates with a conical valve seat in the end cap.

10. The apparatus according to claim 1 wherein the end cap is formed of a ceramic or graphite material.

11. The apparatus according to claim 1 wherein the heating rod extends along the tube to a position adjacent the end cap where the heating rod is bent back to form a U-shaped portion.

12. The apparatus according to claim 1 wherein the tube is arranged for mounting at an exterior location and includes a cowl on an upper end covering the upper end of the tube.

* * * * *